US006703571B2

(12) United States Patent
Nishimoto et al.

(10) Patent No.: US 6,703,571 B2
(45) Date of Patent: Mar. 9, 2004

(54) MULTI-DIRECTIONAL OPERATING SWITCH

(75) Inventors: Takumi Nishimoto, Okayama (JP); Koji Ono, Okayama (JP); Jun Sato, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 9 days.

(21) Appl. No.: 10/204,540

(22) PCT Filed: Jan. 10, 2002

(86) PCT No.: PCT/JP02/00075

§ 371 (c)(1),
(2), (4) Date: Mar. 10, 2003

(87) PCT Pub. No.: WO02/056329

PCT Pub. Date: Jul. 18, 2002

(65) Prior Publication Data

US 2003/0155217 A1 Aug. 21, 2003

(30) Foreign Application Priority Data

Jan. 12, 2001 (JP) ..... 2001-004666

(51) Int. Cl.[7] ..... H01H 9/00
(52) U.S. Cl. ..... 200/6 A; 200/341
(58) Field of Search ..... 200/6 A, 4, 17, 200/18, 341, 335, 534, 559, 283, 542

(56) References Cited

U.S. PATENT DOCUMENTS

| | | | | |
|---|---|---|---|---|
| 4,857,881 A | * | 8/1989 | Hayes | 338/128 |
| 6,211,474 B1 | * | 4/2001 | Takahashi | 200/18 |
| 6,291,782 B1 | * | 9/2001 | Isikawa | 200/14 |
| 6,333,473 B1 | * | 12/2001 | Sawada et al. | 200/4 |

FOREIGN PATENT DOCUMENTS

| | | |
|---|---|---|
| JP | 55-146638 | 10/1980 |
| JP | 58-53122 | 3/1983 |
| JP | 59-144840 | 9/1984 |
| JP | 3-1866 | 12/1986 |
| JP | 6-196045 | 7/1994 |
| JP | 10-125180 | 5/1998 |
| JP | 10-188738 | 7/1998 |
| JP | 11-31440 | 2/1999 |
| JP | 11-120868 | 4/1999 |
| JP | 11-260197 | 9/1999 |
| JP | 2000-149703 | 5/2000 |

OTHER PUBLICATIONS

Patent Abstracts of Japan. Publication No. 10–188738, Published Jul. 21, 1998. (Multidirectional Switch).

Patent Abstracts of Japan. Publication No. 11–031440, Published Feb. 2, 1999. (Multi–Way Operating Switch and Multi–Way Operating Device Using It).

Patent Abstracts of Japan. Publication No. 10–125180, Published May 15, 1998. (Multi–Way Operating Switch, and Multi–Way Operating Device Using the Switch).

* cited by examiner

*Primary Examiner*—Elvin G. Enad
*Assistant Examiner*—K. Lee
(74) *Attorney, Agent, or Firm*—Wenderoth, Lind & Ponack, L.L.P.

(57) ABSTRACT

Operating body 12 is supported by a pair of bearing portions in case 1 such that first shaft 13 is pivotable and second shaft 14 is pivotable and vertically movable in a low range. Operating part 12A is provided on plate part 12B of operating body 12 above the central axis of pivot. Self-restoring first push switch 2 is provided to be in contact with the bottom face of the plate part on the side of second shaft 14 on the central axis of pivot. Self-restoring second push switch 3 and third push switch 4 are provided to in contact with the bottom face of the plate part on the side of first shaft 13 in positions symmetrical with respect to the central axis of pivot. This structure realizes a multidirectional operating switch that allows independent operation of a plurality of switches using one operating part.

6 Claims, 11 Drawing Sheets

MULTI-DIRECTIONAL OPERATING SWITCH

FIELD OF THE INVENTION

The present invention relates to a multi-directional switch that is used in various kinds of electronic equipment, such as an information terminal, and has an operating part to be depressed and tilted.

BACKGROUND OF THE INVENTION

In recent electronic equipment, such as an information terminal, diversification of operation functions as well as downsizing has been proceeding. In order to perform these diversified functions, a large number of switches are used in the electronic equipment. In order to downsize the equipment, the number of operating parts on the operating surface must be reduced. One of the methods taken for these purposes is incorporating, as a constituent member of the electric equipment, an operating mechanism for collectively operating a plurality of switches.

However, the above-mentioned method of incorporating the operating mechanism as a constituent component of the electronic equipment poses problems: difficult engagement of the operating mechanism incorporated in the electronic equipment with a plurality of switches, and moreover expensiveness as electronic equipment.

DISCLOSURE OF THE INVENTION

The present invention addresses these conventional problems. Therefore, the present invention aims to provide, as an integrally formed electronic component, a multi-directional operating switch that can operate a plurality of switches independently by depressing or tilting one operating part.

In order to address the above-mentioned problems, the multidirectional operating switch of the present invention comprises:

- an operating body supported by a pair of bearing portions provided in a case such that one end of the operating body is pivotable and the other end opposite thereto is pivotable and vertically movable in the range below the pivotal position, the operating body having:
  - an operating part provided above the central axis of pivot;
  - a first depressing portion provided on the bottom face of the operating body on the side of the other end on the central axis of pivot as seen from the top; and
  - a pair of second and third depressing portions provided on the bottom face of the operating body on the side of the one end in positions symmetrical with respect to the central axis of pivot; and
- first, second, and third self-restoring push switches provided in the case in positions corresponding to the first, second, and third depressing portions. Depressing the operating part of the operating body allows independent actuation of the first push switch. Tilting the operating part to pivot the operating body in the right or left direction allows independent actuation of the second or third push switch.

PREFERRED EMBODIMENT OF THE INVENTION

Figure 1:
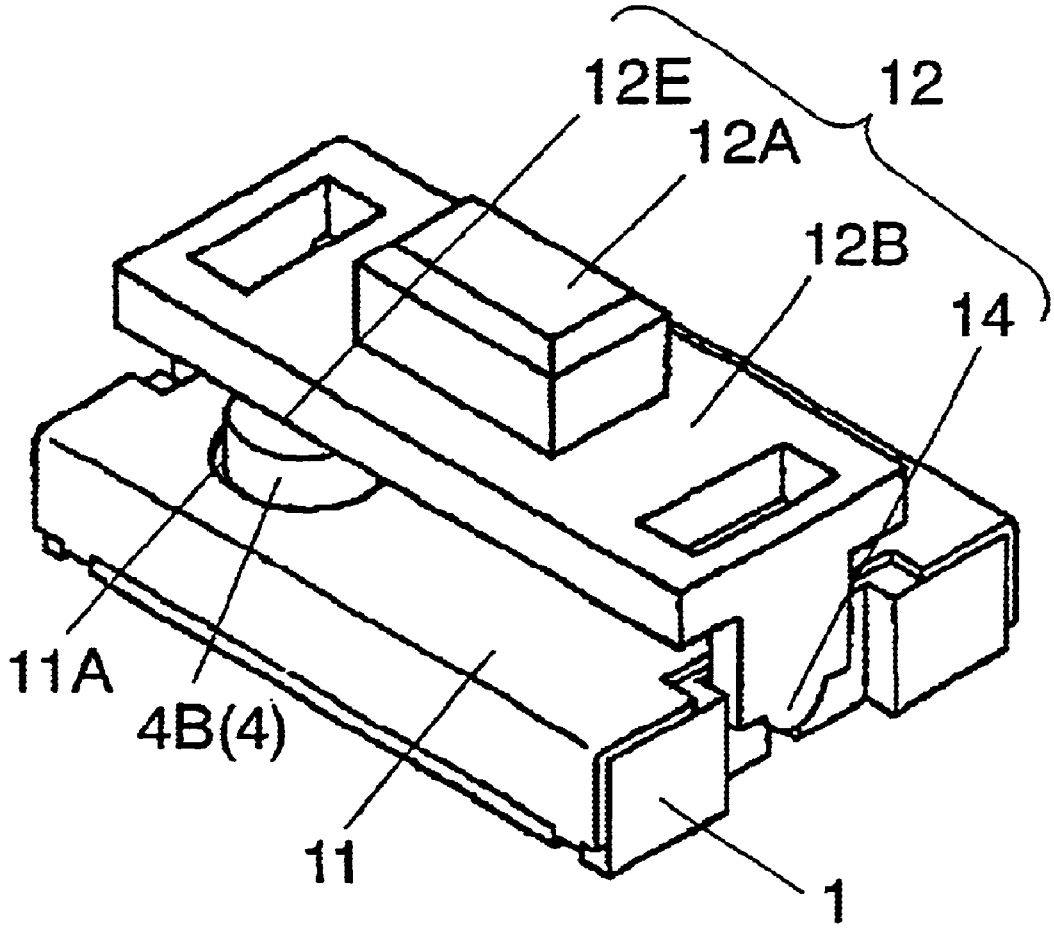
FIG. 1 is a perspective view showing an appearance of a multi-directional operating switch in accordance with an exemplary embodiment of the present invention.
Figure 2:
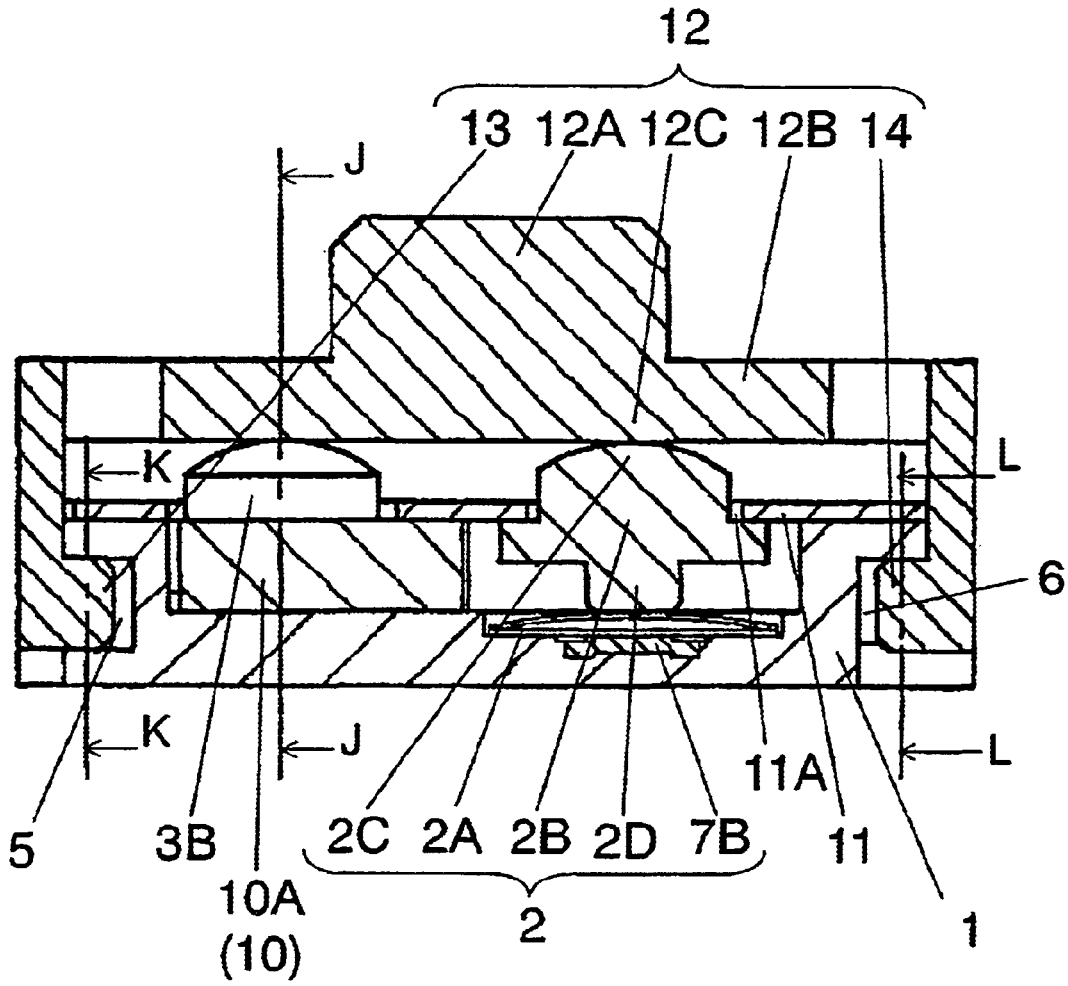
FIG. 2 is a front view in section of the switch.
Figure 3:
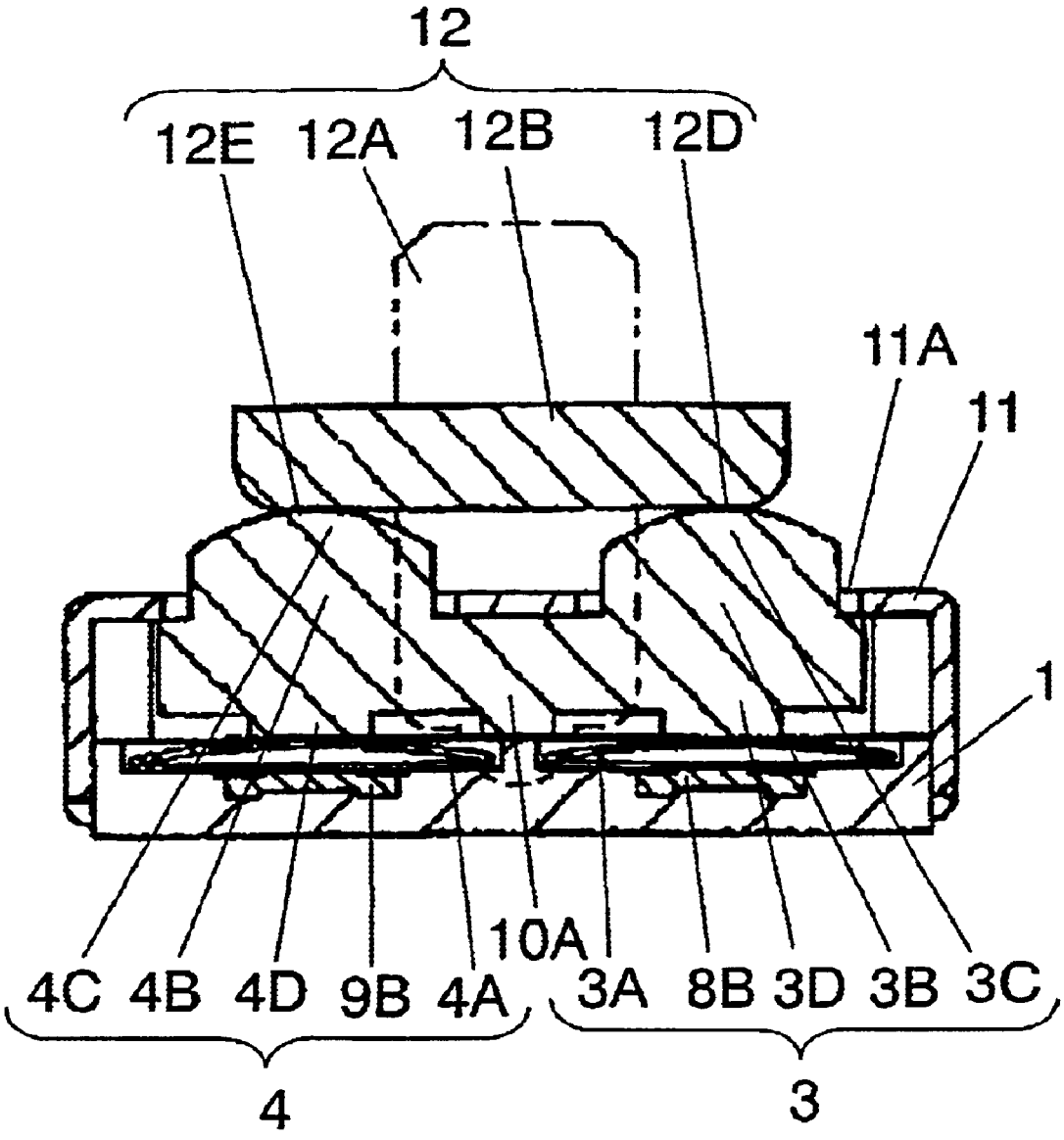
FIG. 3 is a sectional view of the switch taken along line J—J of FIG. 2.
Figure 4:
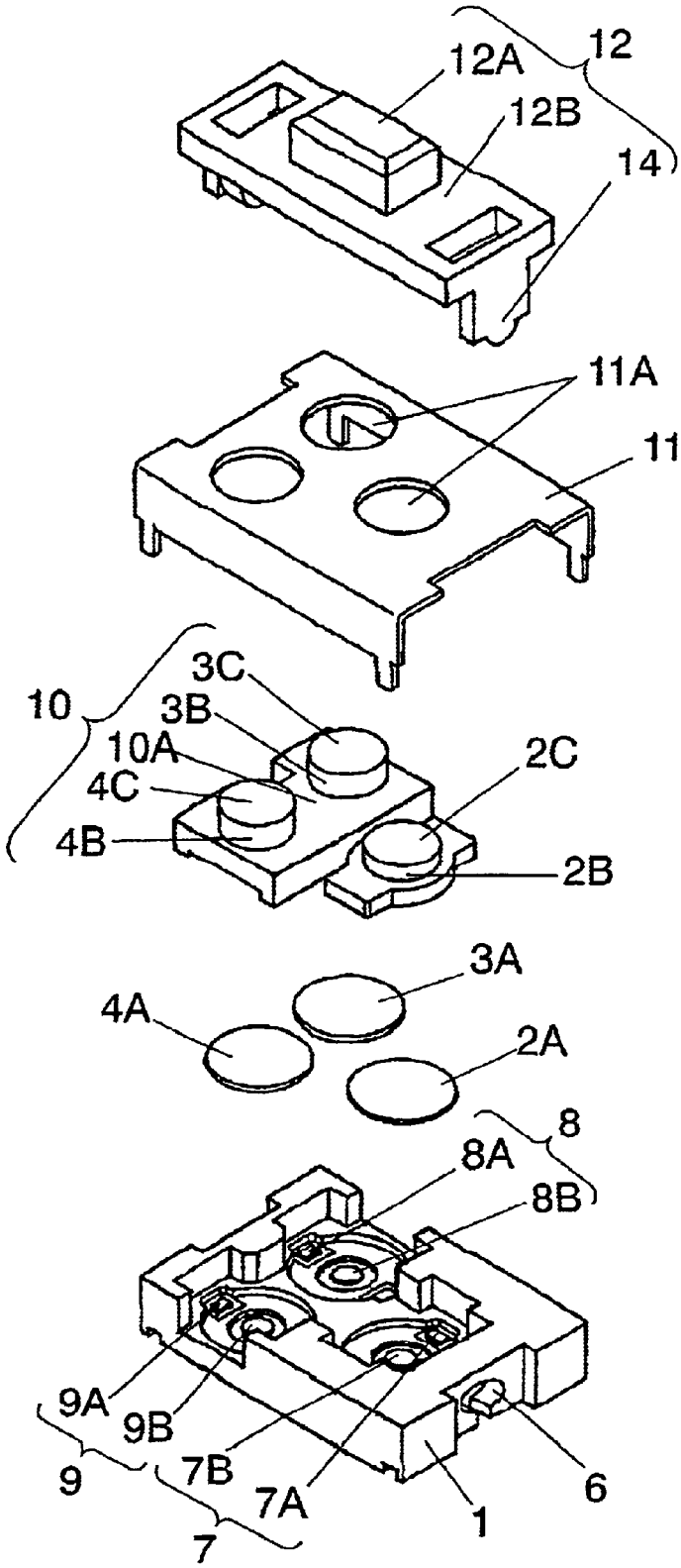
FIG. 4 is an exploded perspective view of the switch.
Figure 5:
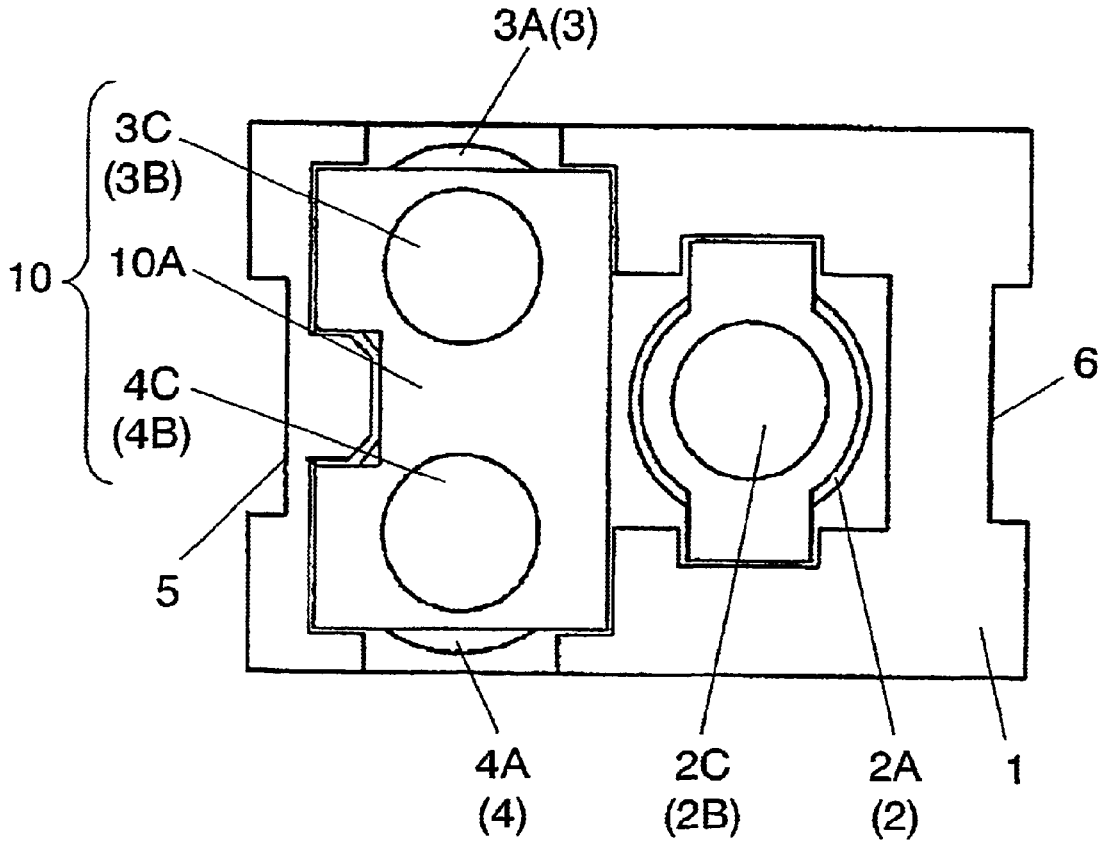
FIG. 5 is a top plan view of the switch with an operating body and a cover thereof removed.

A preferred embodiment of the present invention is demonstrated with reference to FIGS. 1 to 11. FIG. 1 is a perspective view showing an appearance of a multi-directional operating switch in accordance with the exemplary embodiment of the present invention. FIG. 2 is a front view in section of the switch. FIG. 3 is a sectional view of the switch taken along line J—J of FIG. 2. FIG. 4 is an exploded perspective view of the switch. FIG. 5 is a top plan view of the switch with an operating body and a cover thereof removed.

In these drawings, reference numeral 1 shows a box-like case made of an insulating resin and shaped like a rectangle as seen from the top. Provided on the longitudinal central axis and on the right side of the case as seen from the front of the case is first push switch 2 (hereinafter referred to as first switch 2). Provided on the left side of the case in positions symmetrical with respect to the central axis are second push switch 3 and third push switch 4 (hereinafter referred to as second switch 3 and third switch 4, respectively). At the respective centers of opposed left and right walls, i.e. on the central axis, first bearing hole 5 in the left wall and second bearing hole 6 in the right wall are provided, as a pair of bearing portions for supporting operating body 12, which will be described later.

Contact parts of first switch 2 to third switch 4 are structured as shown in FIGS. 2 to 4. In recesses provided in predetermined positions on the bottom of case 1, fixed contact 7 comprising outer circumferential contact 7A and central contact 7B, fixed contact 8 comprising outer circumferential contact 8A and central contact 8B, and fixed contact 9 comprising outer circumferential contact 9A and central contact 9B are insert-molded and fixed. Mounted on each of outer circumferential contacts 7A, 8A, and 9A is the bottom face of the outer circumference of each of circular dome-like movable contacts 2A, 3A, and 4A made of a resilient metallic thin plate. The center of the bottom face of each movable contact is opposed to each of central contacts 7B, 8B, and 9B. Depressing the movable contacts from above turns on/off the switches. This compact contact structure can provide stable switch operation with positive tactile response.

In these three movable contacts 2A to 4A, movable contact 3A in second switch 3 and movable contact 4A in third switch 4 have an identical shape and dimension, and substantially an equal inverting operation force. In other words, second switch 3 and third switch 4 have substantially an equal switch operating force.

Driver 2B made of a rigid insulating material is mounted on the central top of movable contact 2A of the first switch 2. Drivers 3B and 4B made of an elastic insulating material are mounted on the central tops of movable contacts 3A and 4A of the second switch 3 and third switch 4, respectively. Depressing the contacts via these drivers 2B to 4B operates first switch 2 to third switch 4, respectively.

Because driver 3B in second switch 3 and driver 4B in third switch 4 are formed of an elastic insulating material, compressive deformation of these drivers 3B and 4B made before and after the inverting action of the movable contacts 3A and 4A can increase the stroke of the depressing operation and makes it easy to set the operation stroke to predetermined amplitude.

These drivers 3B and 4B have an identical shape and dimension, and are integrally coupled by coupler 10A to form coupled driver 10. At the same time, respective drivers 3B and 4B can elastically be deformed independently. Such a structure can reduce the number of constituent components of the multi-directional operating switch as a whole and facilitates assembling thereof. In addition, this structure stabilizes the mutual position of two drivers 3B and 4B and provides an equal stroke of depressing operation for second switch 3 and third switch 4.

The top plan view of FIG. 5 shows how these first switch 2 to third switch 4 are arranged in case 1.

Cover 11 (see FIG. 4) made of a metallic plate is placed over the top face of case 1 that houses first switch 2 to third switch 4. The cover has three holes 11A through which respective upper halves of drivers 2B to 4B go. Operating body 12 made of a resin is fitted above the cover.

The operating body 12 is supported in the following manner (see FIG. 2). First shaft 13 and second shaft 14 extend downwardly from both longitudinal ends of rectangular plate part 12B so as to be opposed to each other, as two portions to be borne. The first shaft and second shaft are inserted into the above-mentioned first bearing hole 5 and second bearing hole 6 provided in left and right walls of case 1, respectively, and engaged therewith.

Figure 6:
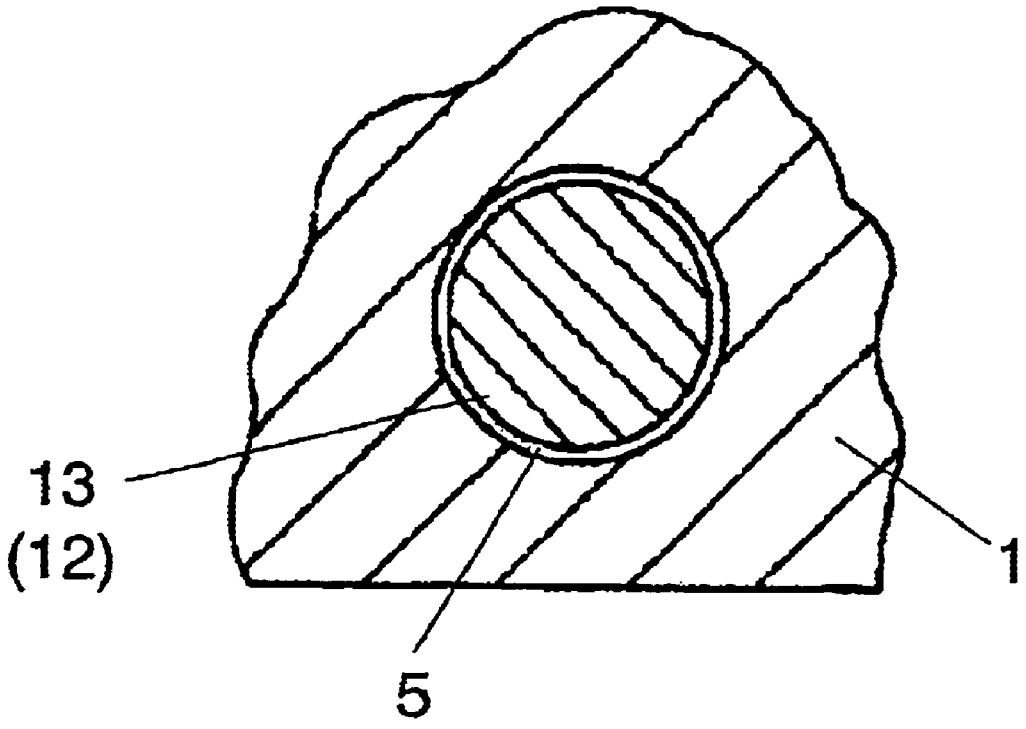
FIG. 6 is a sectional view of the switch taken along line K—K of FIG. 2.
Figure 7:
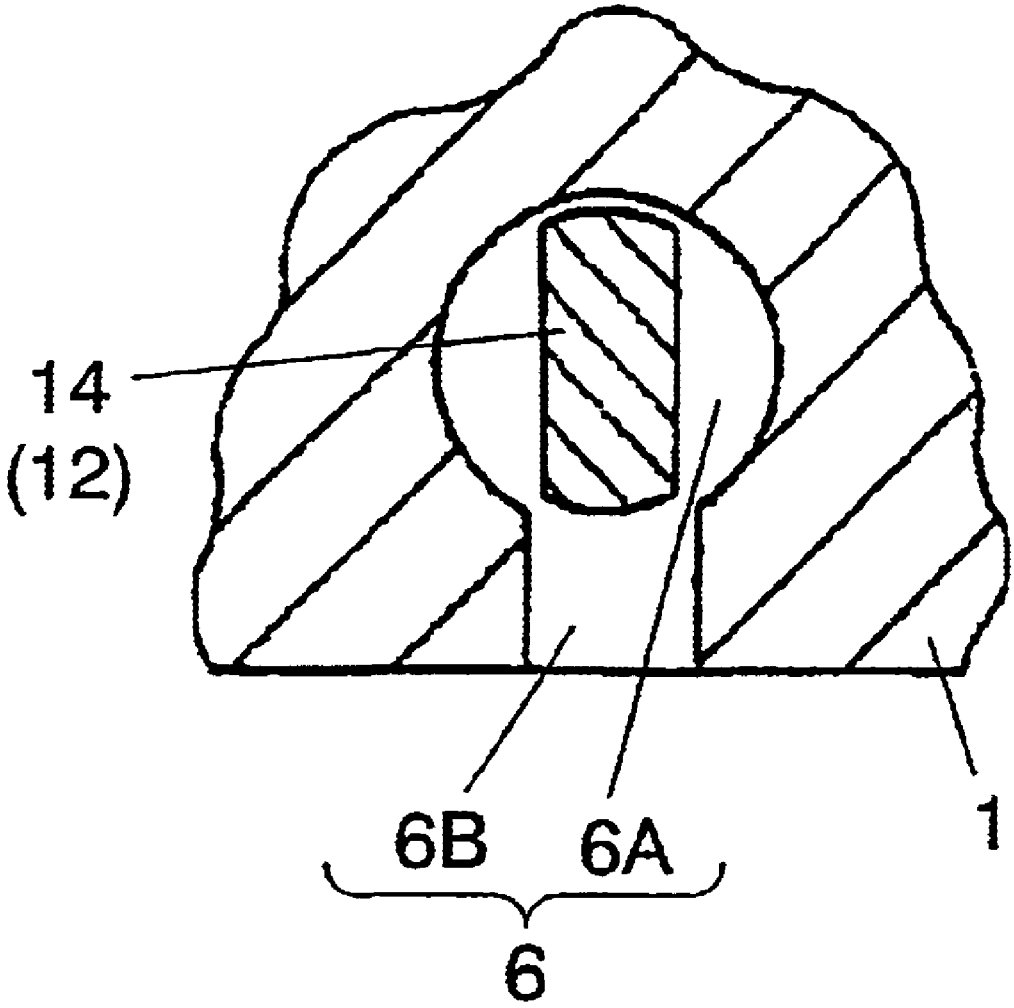
FIG. 7 is a sectional view of the switch taken along line L—L of FIG. 2.

FIG. 6, i.e. a sectional view taken along line K—K of FIG. 2, shows a structure of engagement of shaft 13 with bearing hole 5. FIG. 7, i.e. a sectional view of taken along line L—L FIG. 2, shows a structure of engagement of shaft 14 with bearing hole 6.

In other words, first shaft 13 is shaped like a rod having a circular cross section. First bearing hole 5 is a circular hole having a diameter slightly larger than that of the first shaft. Second shaft 14 is shaped like a rod having an oval cross section with a longer diameter in the vertical direction. Second bearing hole 6 is shaped like a key hole. The key hole comprises circular section 6A having a diameter slightly larger than the longer diameter of the oval shape of second shaft 14 and downwardly projecting section 6B having a width smaller than the longer diameter of the oval shape of second shaft 14 and a slightly larger than the shorter diameter thereof.

This structure allows operating body 12 to be pivotable around a central axis of pivot formed by a line connecting two shafts 13 and 14, i.e. two bearing holes 5 and 6. In addition, the side of second shaft 14 is supported so as to be vertically movable in a range below the pivotal position, only when the orientation of the oval cross section of second shaft 14 corresponds to the direction of downwardly projecting section 6B of second bearing hole 6, i.e. in the neutral position in a normal state (shown in FIG. 7).

Provided on plate part 12B and above the central axis of pivot of operating body 12 is operating part 12A. As first depressing portion 12C, the bottom face of plate part 12 B on the side of second shaft 14 on the central axis of pivot of operating body 12 as seen from the top is in contact with the spherical central top portion of top end 2C of driver 2B in the above-mentioned first switch 2 (see FIG. 2). As second depressing portion 12D and third depressing portion 12E, the bottom face of the plate part in the positions symmetrical with respect to the central axis of pivot is in contact with the respective spherical central top portions of top end 3C of driver 3B in second switch 3 and of top end 4C of driver 4B in third switch 4 (see FIG. 3). This arrangement maintains operating body 12 in the neutral position and thus second shaft 14 at rest in the neutral position as shown in FIG. 7.

The multi-directional operating switch of this embodiment is structured as described above. Next, the operations thereof are described.

A first operation is performed with reference to FIG. 3, i.e. one of sectional views showing the normal state of this multi-directional operating switch. Pressing force in the right direction is applied to operating part 12A of operating body 12 to tilt the operating body. Then, as shown in the sectional view of FIG. 8, operating body 12 pivots in the right direction around a central axis of pivot, i.e. the line connecting first shaft 13 borne by bearing hole 5 and second shaft 14 borne by bearing hole 6 in case 1.

Figure 8:
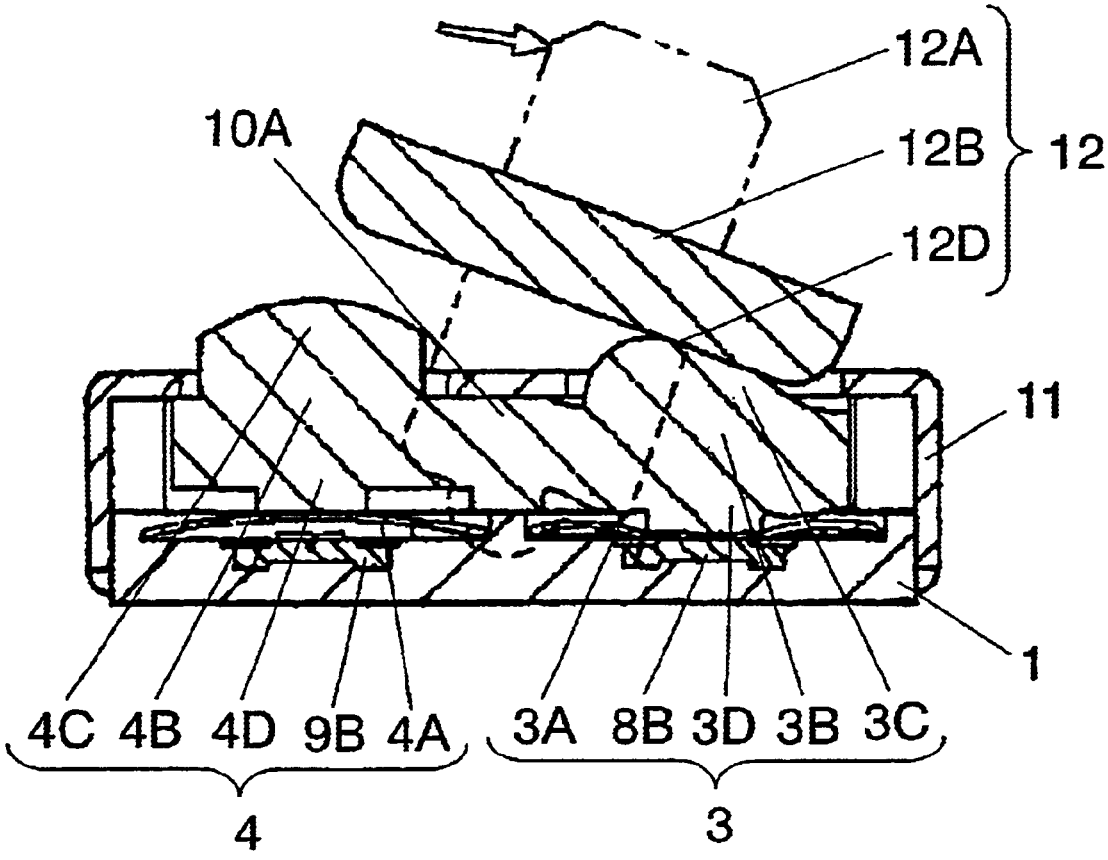
FIG. 8 is a sectional view of the switch when the operating body is tilted from the state shown in FIG. 3.
Figure 9:
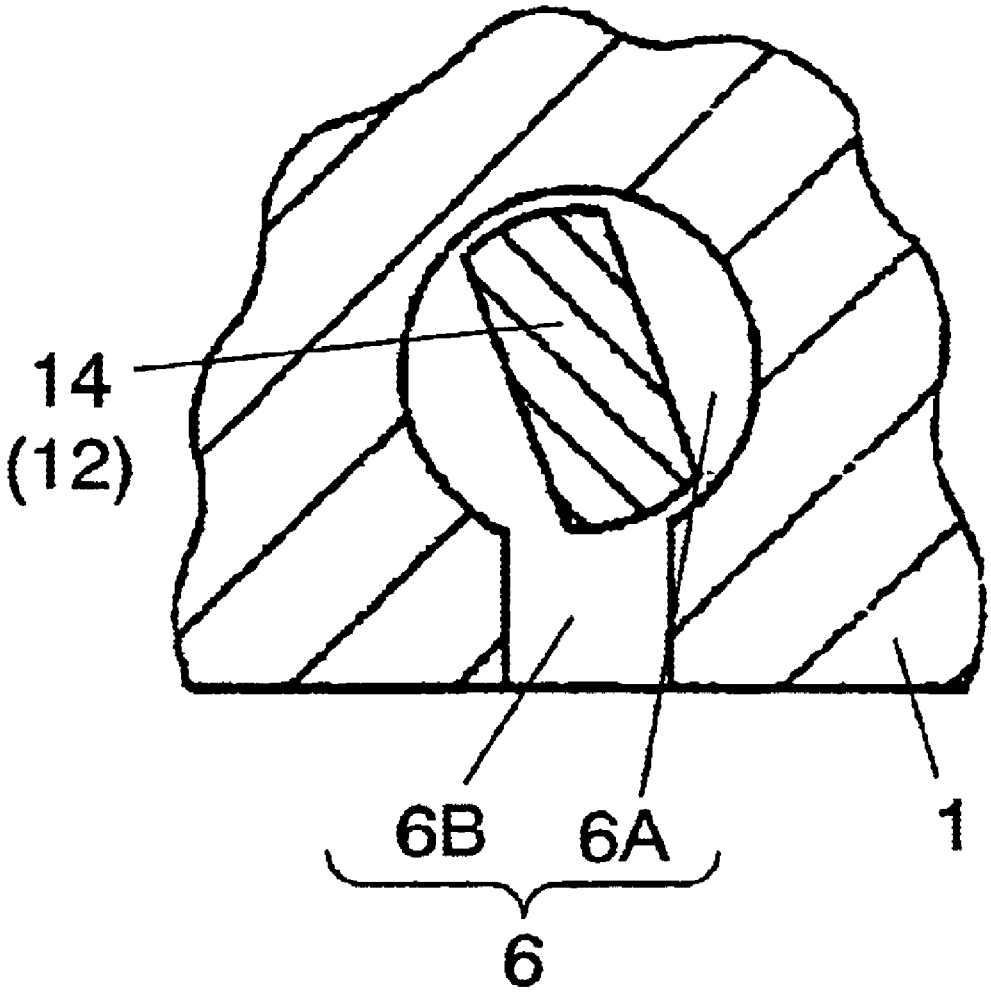
FIG. 9 is a sectional view of the switch when the switch in the state shown in FIG. 8 is taken along line L—L of FIG. 2.
Figure 10:
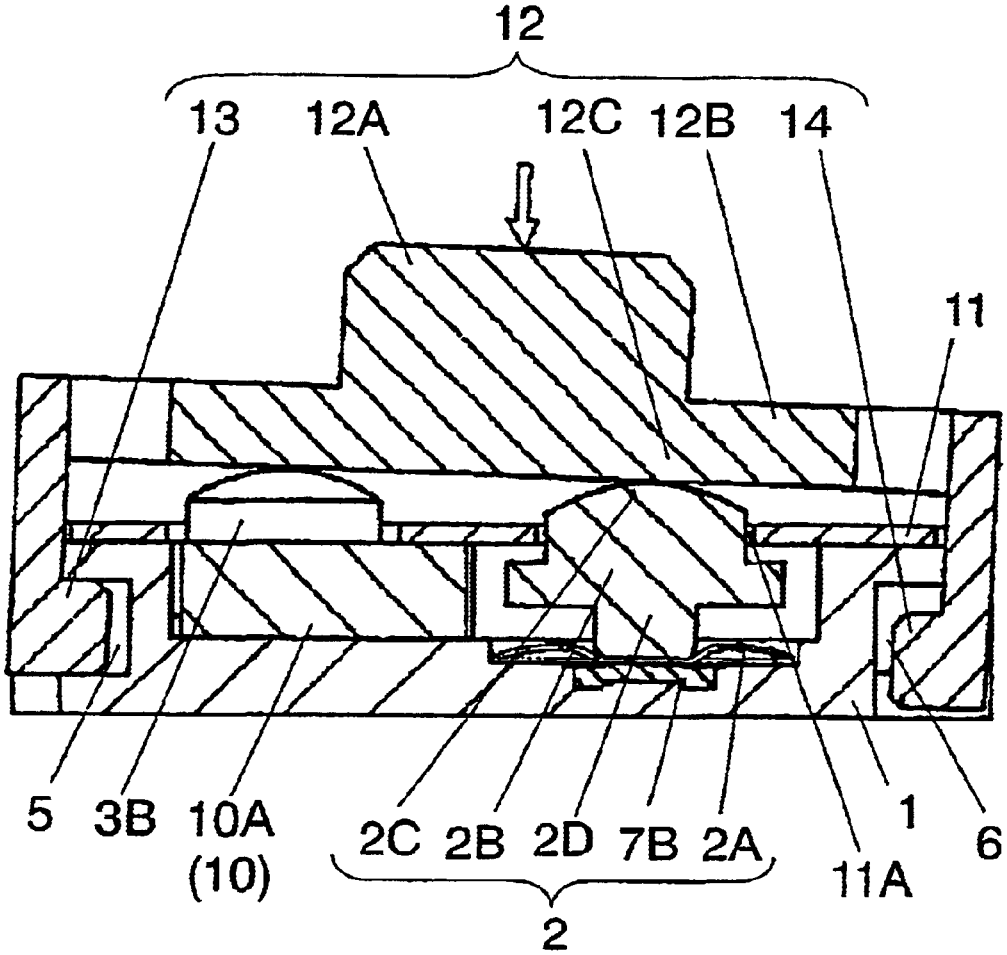
FIG. 10 is a sectional view of the switch when the operating body is depressed from the state shown in FIG. 2.

Accordingly, the right side of plate part 12B of operating body 12 tilts downwardly. As second depressing portion 12D, the bottom face of the plate part depresses spherical top end 3C of driver 3B in second switch 3 downwardly. While elastically deforming the central top portion of driver 3B made of an elastic insulating material, the second depressing portion depresses the entire driver downwardly. When the depressing force applied to the central top of movable contact 3A in second switch 3 by the bottom end 3D of driver 3B exceeds the inverting operation force of movable contact 3A, movable contact 3A inverts with positive tactile response and the central bottom thereof makes contact with central contact 8B, as shown in FIG. 8. This contact action short-circuits outer circumferential contact 8A (not shown in FIG. 8) and central contact 8B, thereby actuating second switch 3. This signal is transferred to the circuit of the electronic equipment using this multi-directional operating switch, via leads (not shown) connected to each contact.

Thereafter, when the depressing force in the right direction applied to operating part 12A is removed, movable contact 3A and driver 3B attempt to restore to the original shapes thereof using respective elastic restoring forces. These restoring forces move up plate part 12B of operating body 12 and thus restore the switch to the normal state shown in FIG. 3.

Similarly, with reference to FIG. 3, when depressing force in the left direction is applied to operating part 12A, operating body 12 pivots in the left direction. Then, as third depressing portion 12E, the bottom face of plate part 12B on the left side depresses driver 4B and thereby bottom end 4D of the driver depresses movable contact 4A. This action can actuate third switch 4.

When operating part 12A is pressed in the right or left direction to pivot operating body 12, first shaft 13 having a circular cross section at the one end of operating body 12 that is engaged with circular first bearing hole 5 in case 1 does not move downwardly even though operating body 12 pivots. The second shaft 14 having the oval cross section also does not move downwardly. This is because the orientation of the oval cross section is displaced from the direction of downwardly projecting section 6B of second bearing hole 6, as shown in the sectional view of FIG. 9, when operating body 12 pivots in the right or left direction from the neutral position (see FIG. 7) in the normal state.

As a result, in the tilting operation of operating part 12A, malfunction does not occur in first switch 2 in which the spherical central top portion of top end 2C of driver 2B is in contact with first depressing portion 12C on the bottom face of plate part 12B on the central axis of pivot of operating body 12 as seen from the top.

Both top end 3C of driver 3B in second switch 3 and top end 4C of driver 4B in third switch 4 are depressed by second depressing portion 12D and third depressing portion 12E, respectively, on the bottom face of plate part 12B of pivoted operating body 12, when this operating part 12A is tilted. Because theses top ends of these drivers are both spherical and thus each of depressing portion 12D and 12E positively holds down the central top portion of each driver, second switch 3 and third switch 4 perform stable operation.

Next, a second operation is performed with reference to FIG. 2, i.e. one of sectional views showing the normal state of this multidirectional operating switch. Downward depressing force is applied to operating part 12A of operating body 12. First shaft 13 and second shaft 14 at both ends of operating body 12 are inserted and engaged with first bearing hole 5 and second bearing hole 6 in case 1, respectively. As mentioned above, first shaft 13 does not move downwardly. However, second shaft 14 moves downwardly from the neutral position. Therefore, operating body 12 tilts around a fulcrum at bearing hole 5 in case 1 bearing first shaft 13, and thereby the side of second shaft 14 goes down, as shown in the sectional view of FIG. 10.

As a result, first depressing portion 12C on the bottom face of plate part 12B of operating body 12 depresses spherical top end 2C of driver 2B in first switch 2 that is in contact with the first depressing portion 12C on the side of second shaft 14 on the central axis of pivot of operating body 12 as seen from the top. This action depresses driver 2B made of a rigid insulating material downwardly. When the depressing force applied to the central top of movable contact 2A in first switch 2 by bottom end 2D of driver 2B exceeds the inverting operation force of movable contact 2A, movable contact 2A inverts with positive tactile response and the central bottom thereof makes contact with central contact 7B, as shown FIG. 10. This contact action short-circuits outer circumferential contact 7A (not shown in FIG. 10) and central contact 7B, thereby actuating first switch 2. This signal is transferred to the circuit of the electronic equipment using this multi-directional operating switch, via leads (not shown) connected to each contact.

Thereafter, when the downward depressing force applied to operating part 12A is removed, movable contact 2A attempts to restore to the original shape thereof using the resilient restoring force of its own. This restoring force moves up plate part 12B of operating body 12 and thus restores the switch to the normal state shown in FIG. 2.

When operating part 12A is depressed downwardly to tilt operating body 12, top end 3C of driver 3B in second switch 3 and top end 4C of driver 4B in third switch 4 that are in contact with the bottom face of plate part 12B of operating body 12 on the side of first shaft 13 in positions symmetrical with respect to central axis of pivot of the above-mentioned operating body 12 are slightly depressed downwardly. However, since drivers 3B and 4B are made of an elastic insulating material, slight elastic deformation of respective top ends 3C and 4C thereof accommodate to this movement. This prevents the influence on contact parts in second switch 3 and third switch 4.

Figure 11:
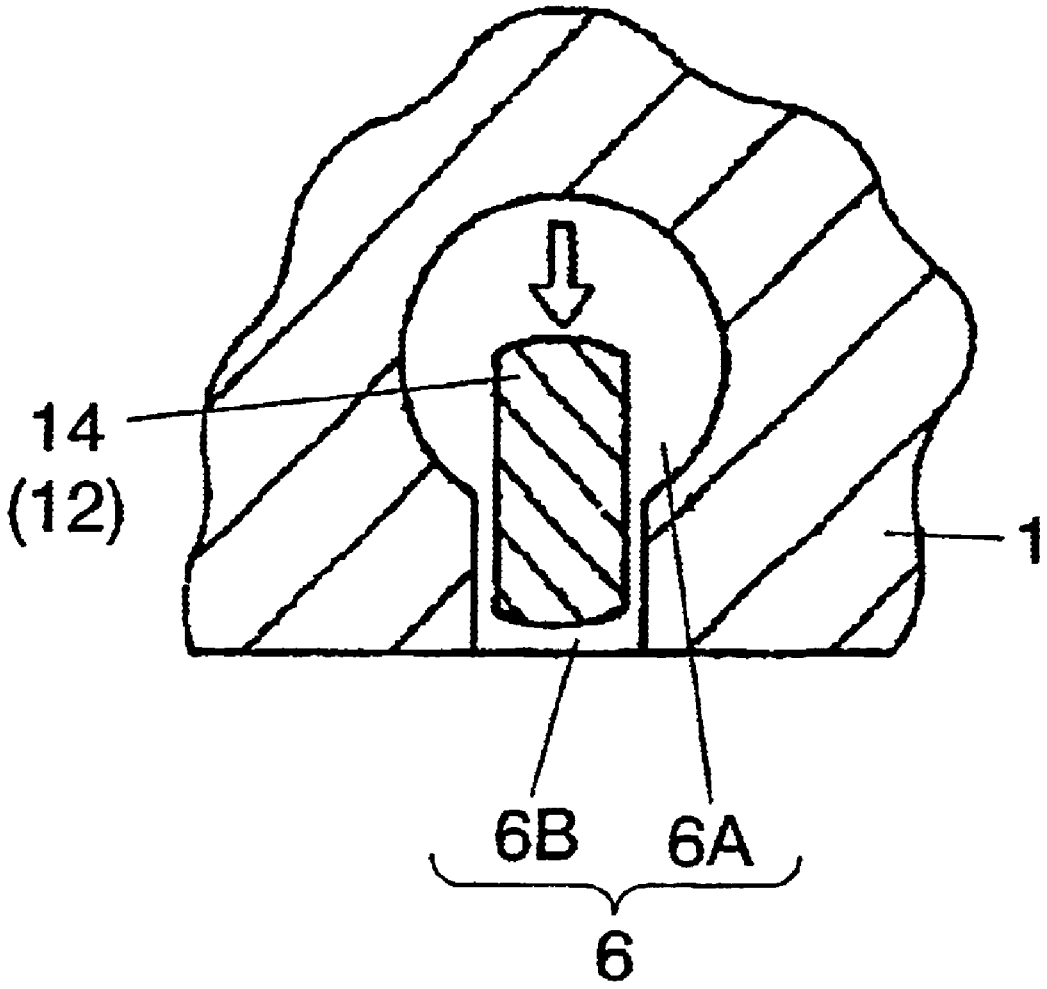
FIG. 11 is a sectional view of the switch when the switch in the state shown in FIG. 10 is taken along line L—L of FIG. 2.

When operating part 12A is depressed downwardly to tilt operating body 12, second shaft 14 having an oval cross section at the end of operating body 12 that is engaged with second bearing hole 6 in case 1 goes from circular section 6A into downwardly projecting section 6B of second bearing hole 6 shaped like a key hole, as shown in the sectional view of FIG. 11. Downwardly projecting section 6B is smaller than the longer diameter of the oval shape of second shaft 14 in the vertical direction and slightly larger than the shorter diameter thereof in width. Thus second shaft 14 can hardly rotate in this condition, that is, operating body 12 cannot pivot.

Consequently, during depressing operation of operating part 12A, malfunction does not occur in second switch 3 in which top end 3C of driver 3B is in contact with second depressing portion 12D on the bottom face of plate part 12B of operating body 12 and in third switch 4 in which top end 4C of driver 4B is in contact with third depressing portion 12E thereon.

As mentioned above, with the multi-directional operating switch of this embodiment, a first operation of tilting operating part 12A to pivot operating body 12 in the right or left direction allows independent actuation of second switch 3 or third switch 4. In addition, a second operation of depressing operating part 12A allows independent actuation of first switch 2. This structure can provide the following applications. For example, with such information terminals as a cell phone, the first operation of tilting operating part 12A allows a cursor movement for selection of a menu and the second operation of depressing operating part 12A allows determination and execution of the selected menu.

In the above description, the first operation is tilting operating part 12A and the second operating is depressing operating part 12A. However, any order of operations is acceptable for convenience of the electronic equipment using this multi-directional operating switch.

Industrial Applicability

The multi-directional operating switch of the present invention can operate a plurality of push switches independently by depressing or tilting one operating part. Thus, this operating switch finds a wide range of applications in electronic equipment, such as various kinds of information terminals.

What is claimed is:

1. A multi-directional operating switch comprising:

an operating body supported by a pair of bearing portions provided in a case such that one end of said operating body is pivotable and an other end opposed thereto is pivotable and vertically movable in a range below a pivotal position, said operating body having:

an operating part provided above a central axis of pivot;

a first depressing portion provided on a bottom face of said operating body on a side of the other end on the central axis of pivot as seen from a top; and a pair of second and third depressing portions provided on the bottom face of said operating body on a side of the one end in positions symmetrical with respect to the central axis of pivot; and first, second, and third self-restoring push switches provided in the case in positions corresponding to said first, second, and third depressing portions;

wherein depressing said operating part allows actuation of said first push switch, and tilting said operating part to pivot said operating body in one of right and left directions allows actuation of one of said second and third push switches.

2. The multi-directional operating switch as set forth in claim 1, wherein a borne portion at the other end of said operating body is shaped like a rod having an oval cross section longer in a vertical direction, a bearing portion in the case for bearing the borne portion is a hole shaped like a key hole, and said key hole comprises a circular section having a diameter slightly larger than a longer diameter of the oval cross section and a downwardly projecting section having a width smaller than the longer diameter and slightly larger than a smaller diameter of the oval cross section.

3. The multi-directional operating switch as set forth in claim 1, wherein any of said first, second, and third push switches is formed by mounting a circular dome-like movable contact made of a resilient metallic thin plate on a fixed contact insert-molded and fixed in the case and disposing a driver made of an insulating material on the movable contact.

4. The multi-directional operating switch as set forth in claim 3, wherein any of said second and third push switches is a type depressing the movable contact via the driver formed of an elastic insulating material.

5. The multi-directional operating switch as set forth in claim 4, wherein the drivers for said second and third push switches are integrally coupled by an elastic insulating material and elastically deformable independently.

6. The multi-directional operating switch as set forth in claim 3, wherein at least tips of the drivers for said second and third push switches are spherical and said second and third depressing portions of said operating body are in contact with respective central top portions of the tips.

* * * * *